US006339852B1

(12) United States Patent
Huang

(10) Patent No.: US 6,339,852 B1
(45) Date of Patent: Jan. 22, 2002

(54) BIDET TOILET SEAT

(76) Inventor: Sung F. Huang, 4694 Portofino Cir., Cypress, CA (US) 90630

( * ) Notice: Subject to any disclaimer, the term of this patent is extended or adjusted under 35 U.S.C. 154(b) by 0 days.

(21) Appl. No.: 09/689,923

(22) Filed: Oct. 13, 2000

(51) Int. Cl.[7] ..... A47K 3/26; E03D 9/08

(52) U.S. Cl. ..... 4/420.4; 4/420.5; 4/444; 4/447

(58) Field of Search ..... 4/420.1, 420.4, 4/420.5, 443, 444, 447, 448

(56) References Cited

U.S. PATENT DOCUMENTS 1,787,481 A * 1/1931 Kellogg ..... 4/420.5
2,600,619 A * 6/1952 Conterno ..... 4/420.4
3,879,769 A 4/1975 Slawinski et al.
4,967,423 A * 11/1990 Aoyama ..... 4/420.4
5,241,712 A * 9/1993 Mahoney ..... 4/420.4 X
5,279,001 A * 1/1994 Vento ..... 4/447
5,504,948 A 4/1996 Chandler
5,566,402 A 10/1996 Agha el-Rifai et al.

* cited by examiner

*Primary Examiner*—Timothy L. Maust
*Assistant Examiner*—Kathleen J. Prunner

(57) ABSTRACT

A bidet toilet seat has a plurality of spaced-apart nozzle holes disposed at a frontal lower portion of the seat and adapted to provide a plurality of water streams extending generally horizontally and at limited upward inclination to contact intimate areas of a person seated on the seat. Water flow and force of the streams are controlled by a valve to govern force and distance of the streams. The nozzle holes are defined in a conduit attached to the seat or defined within the seat.

15 Claims, 5 Drawing Sheets

BIDET TOILET SEAT

BACKGROUND OF THE INVENTION (1) Field of the Invention

The present invention relates generally to toilets arid, more specifically, a simple, useful, cost-effective and affordable toilet seat having a bidet built therein, whereby cleansing the anal and genital areas of the human body is effected.

(2) Description of the Related Art

Many prior art combinations of a toilet seat and bidet attachment are typically bulky and awkward to use, however, most of these devices are characterized by an undue level of mechanical complexity which may affect their reliability, the mechanisms and moving parts of the said combinations are unsightly, exposed and cumbersome during a man's period of use in the restroom. Furthermore, when the toilet seat has been raised it is a fact of life that when a man uses a commode with the toilet seat raised, a certain amount of splatter of a corrosive and unsanitary liquid results, a splatter which must be constantly cleaned from all surfaces on which it lands. The bidet attachments of the prior art are particularly susceptible to this splatter due to their exposure. Because of their size and intricate mechanisms, they are uncomfortable to the user and difficult to keep clean. As a result, although the use of bidets is popular and desirable where they are available, because of their complexity and unsightly appearance, they have not become popular or commercially available. The lack of practicality may be the bottom line of consumers' passive attitude towards this remarkable device.

Particularly, without any exposed mechanisms, moving parts or rigid bidet arm, this invention is very convenient to the user and is easy to maintain and keep clean.

BRIEF SUMMARY OF THE INVENTION

The present invention provides a simple and effective toilet bidet seat which has a conduit built around the bottom side of the inner rim of the toilet seat, as shown in FIGS. 6 and 7. The conduit may comprise a passage within the frontal portion of the seat, as indicated in FIG. 8A. The conduit typically comprises a tube formed of appropriate plastic, and has nozzle holes located on the rim edge, water streams project out horizontally with a slightly upward angle on the nozzle holes, the nozzle holes having respective orientations to direct respective water streams in a generally converging pattern, as indicated in FIG. 1. The water streams cleanse the human intimate area which generally are disposed inches below the horizontal water stream line. The nozzle holes are so spaced that a central space or area has no nozzle holes as shown in FIG. 4, thus to avoid direct impingement of water streams on male genitalia. The desired water pressure and angle of projection are controlled by an inline valve. This inline valve is mounted on the toilet seat at the end of the conduit and is manually operable to control flow. The inline valve is then connected to the toilet's water line or an adjacent pre-mixed hot and cold-water faucet. The valve and conduit are connected with a utility water supply.

This invention has a circular conduit built around the inner rim of a toilet seat and has several nozzle holes located on the lower side of the conduit in the front rim area. The conduit is then connected by a flexible tube to a pre-mixed cold and hotwater faucet. Water pressure and streams projection control are by an adjustable valve. Sprinklers serve to shoot a water stream out horizontally parallel along the user's thigh, toward the center of the back, to cleanse the user's private parts which generally sit inches below their thigh.

DETAILED DESCRIPTION OF THE INVENTION

Figure 1:
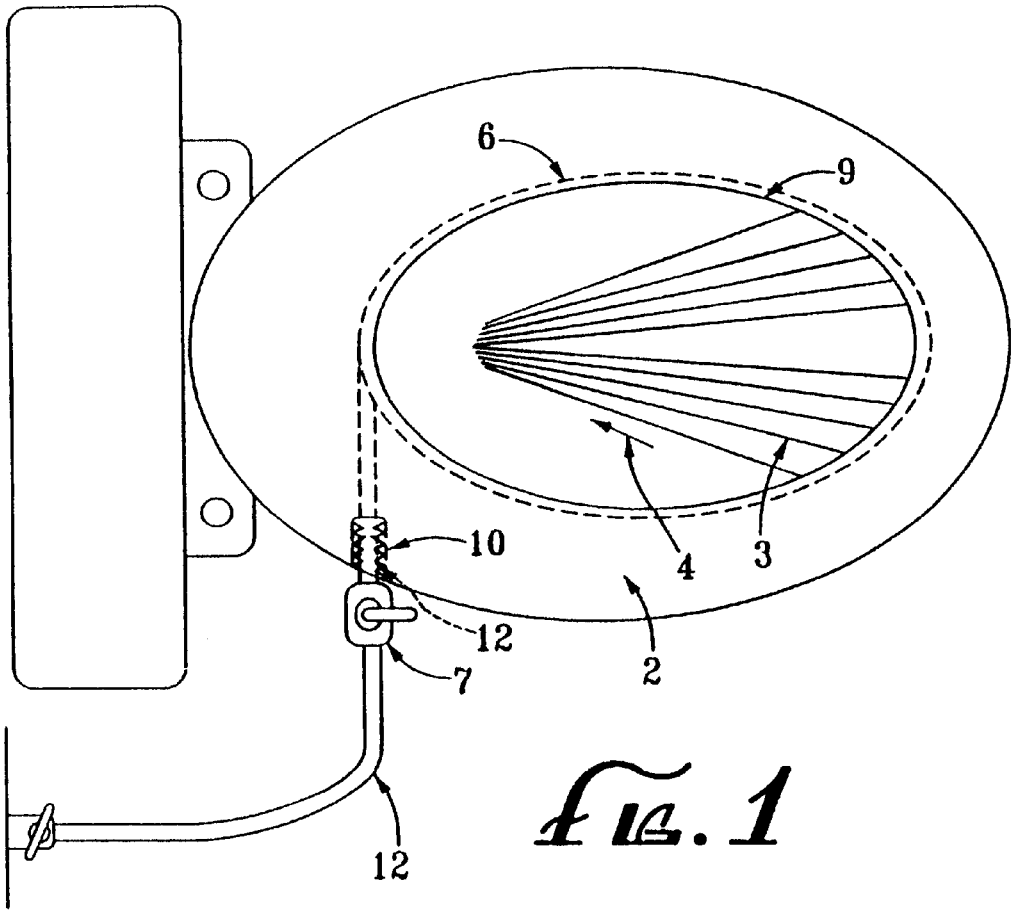
FIG. 1 is a top view of a sprinkler bidet and toilet seat with a flush closet showing water streams.

Referring to the drawings, FIG. 1 shows a bidet toilet seat 2, pivotally connected to a toilet bowl, as indicated at 16 (FIG. 3), with water streams 3 extending out horizontally from front to rear 4 parallel under the user's thigh to reach their target, instead of the vertical water projection used in the prior art (which generally needs a shaft, a nipple or a nozzle gun operated by a mechanical arm). The inner rim of the toilet seat 2 ends with a connector 10, connected by a flexible tube 12 with an adjustable valve 7 to a water source 15.

Figure 2:
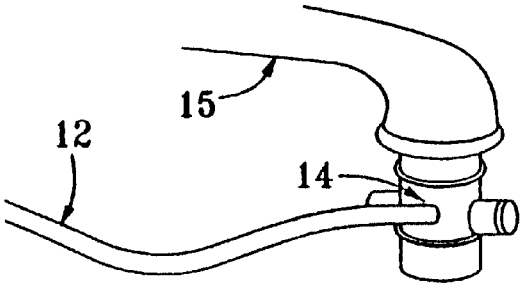
FIG. 2 is a perspective view of a faucet with a water diverter showing the water source for the bidet.
Figure 3:
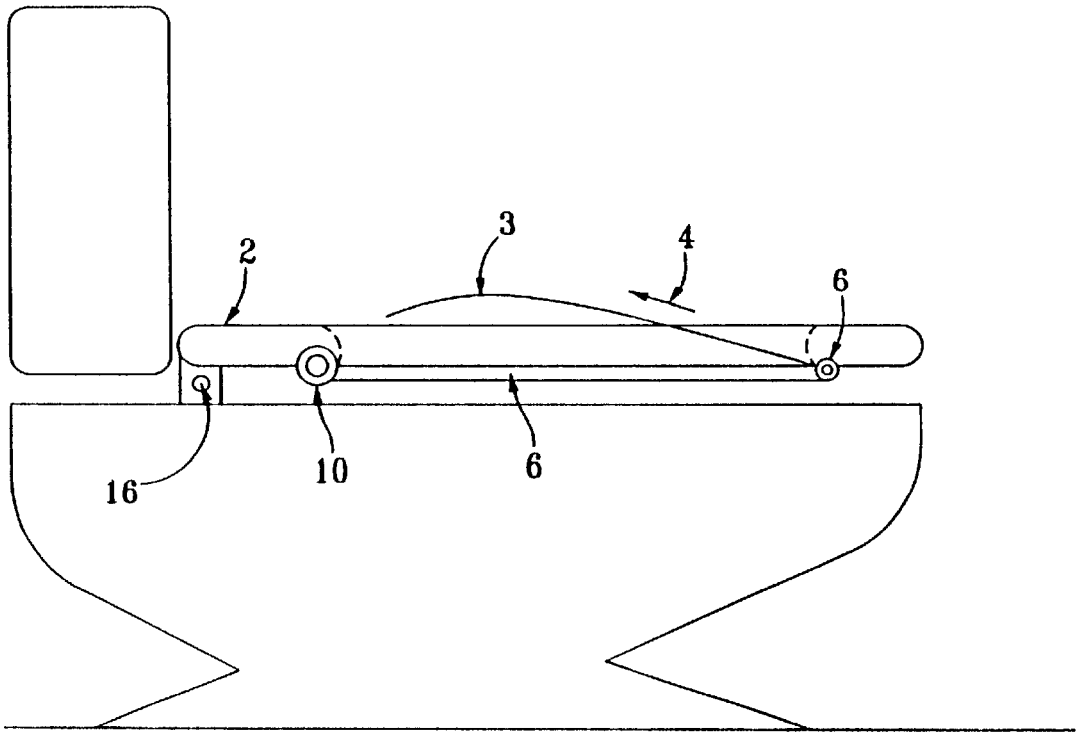
FIG. 3 is a side view of the circular sprinkler bidet with a flush closet showing a water stream projecting slightly upward.
Figure 4:
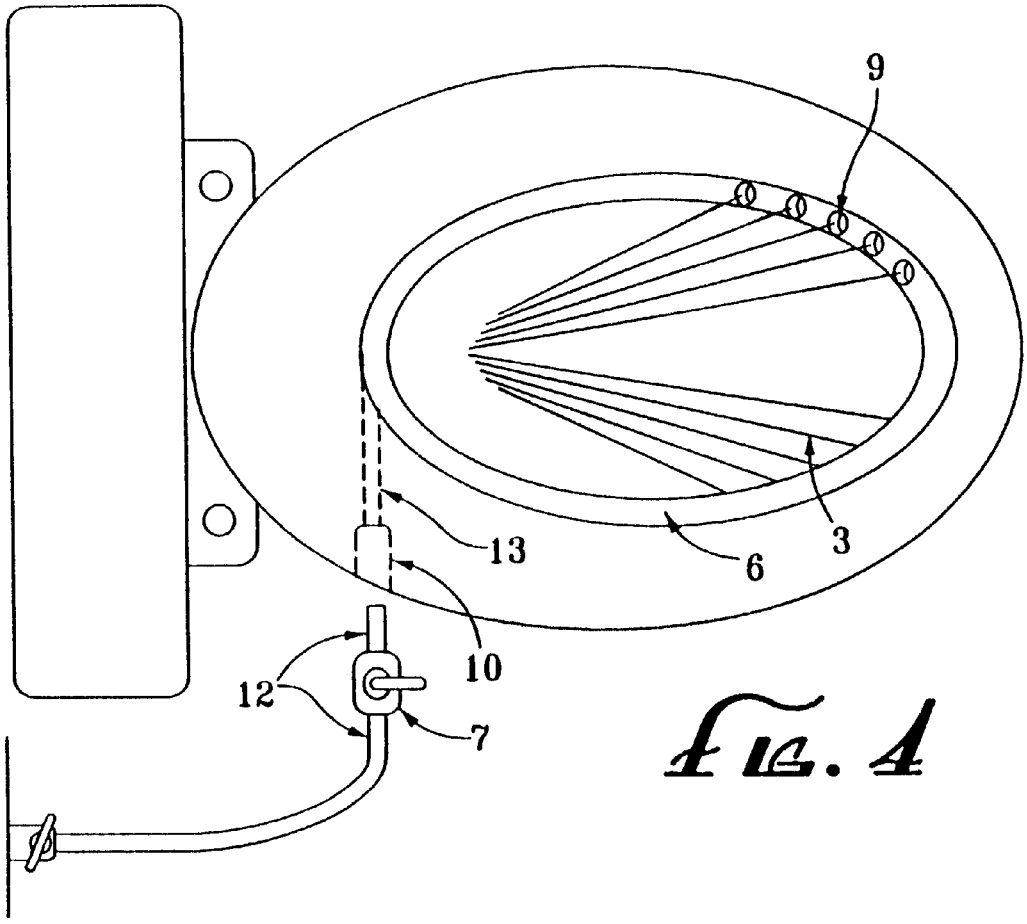
FIG. 4 is a bottom view thereof showing the positions of nozzle holes and a water inlet tubing inserted into the bidet via a connector and an adjustable valve.

FIG. 2 shows a conventional water diverter valve 14, which has been publicly used for years. FIG. 3 shows the water stream 3 extending horizontally with a slightly upward angle. FIG. 4, a bottom view of the seat, shows a partial perspective view of the nozzle holes 9 located on both sides of the front rim (except the center area) near the lower part of circular conduit 6 which is connected by conduit 13 which is a hollow channel inside the seat.

Figure 5:
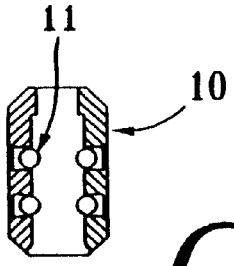
FIG. 5 is an exploded view of the connector.
Figure 6:
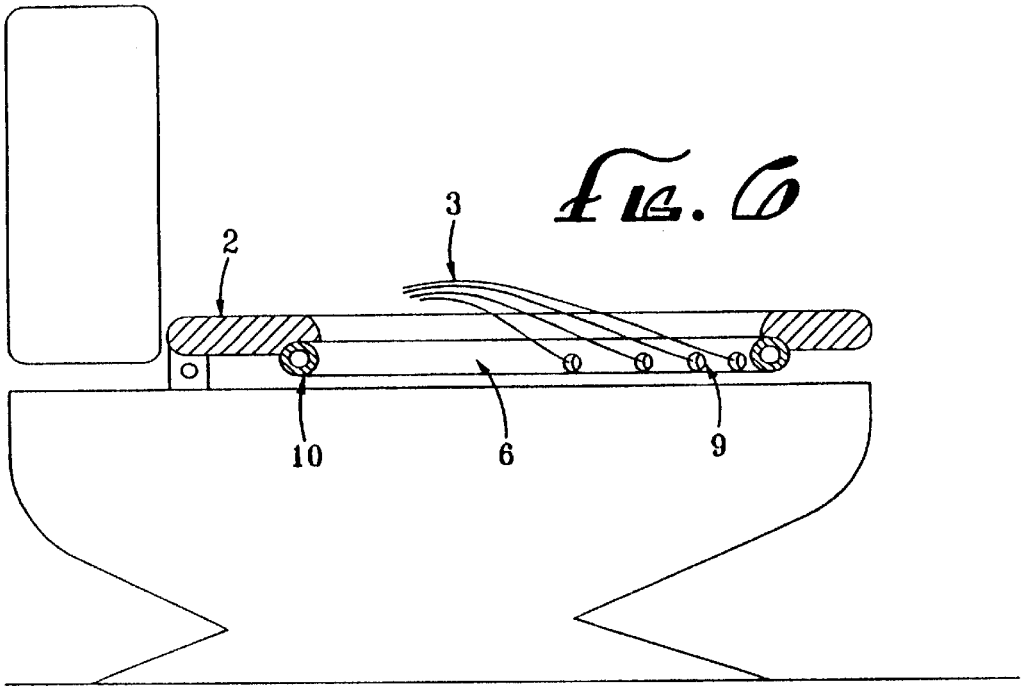
FIG. 6 is a cross-sectional view of the bidet showing the conduit and position of nozzle holes.
Figure 7:
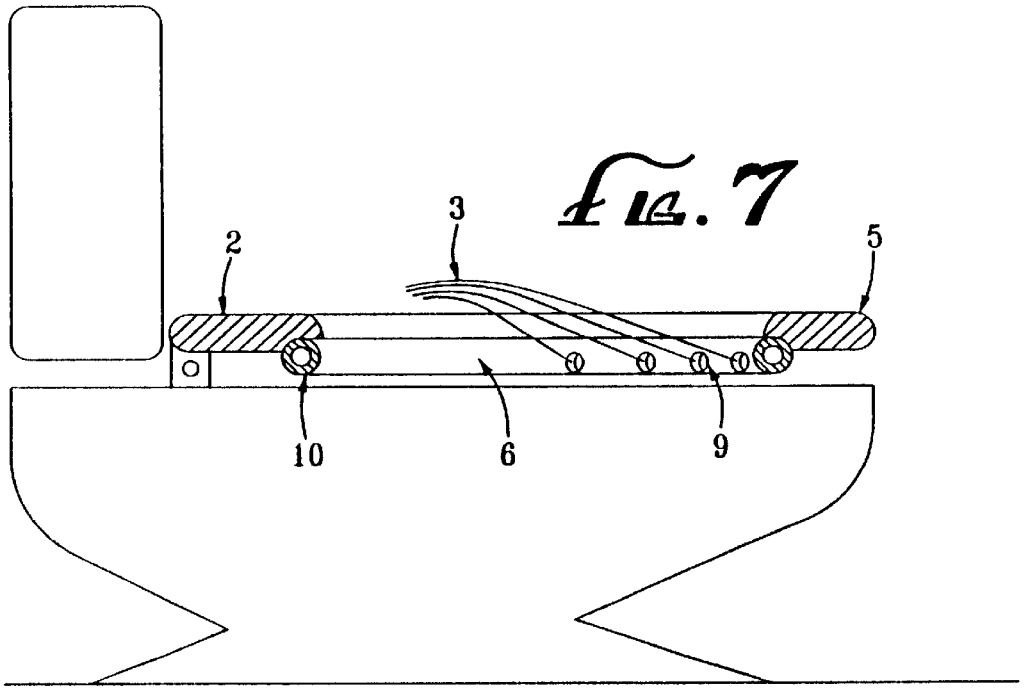
FIG. 7 is a side view thereof showing a front part of the rim.
Figure 8:
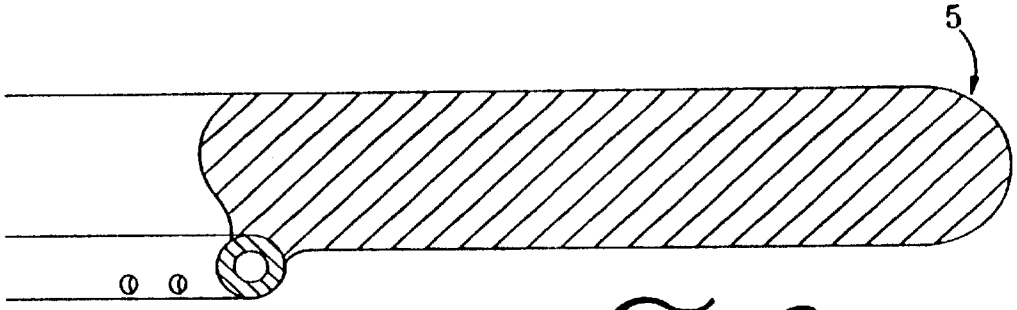
FIG. 8 is an exploded cross-sectional view of the front rim showing the position of the conduit.
Figure 8A:
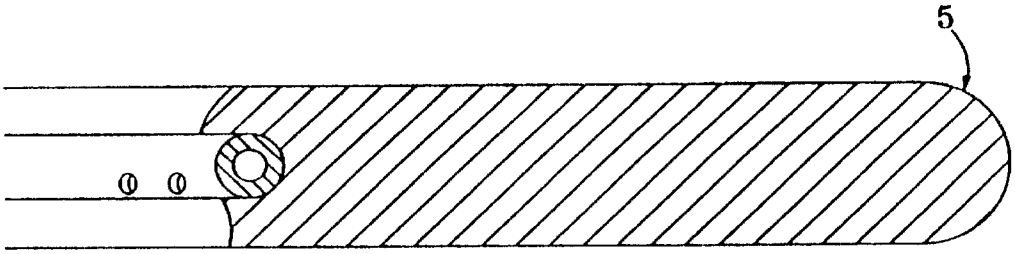
FIG. 8A is a sectional view of a rim of a modified toilet seat showing a conduit mounted therein.
Figure 9:
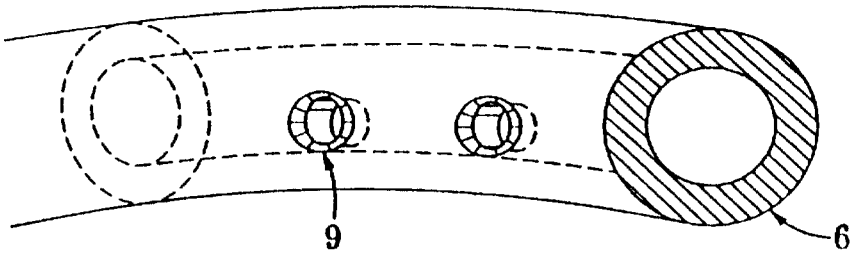
FIG. 9 is a perspective view showing the nozzle holes.

FIG. 5 shows connector 10 with O-rings 11 or threads inside. FIG. 6 is a cross-sectional view of the seat showing the positions of the nozzle holes 9 and conduit 6. FIG. 7 is a side view of the seat showing the front part of the rim 5. FIG. 8 is an exploded cross-sectional view of the front rim 5 inside the bottom of the inner rim of the bidet seat showing the position of the conduit 6. FIG. 8A is a cross-sectional view of another form of a portion of a modified bidet seat showing a conduit disposed within the toilet seat. FIG. 9 is a perspective view showing nozzle holes 9.

I claim:

1. A bidet toilet seat comprising:

a toilet seat having an arcuate frontal portion, a central opening, and a rear portion pivotally connected with a toilet bowl, conduit means having a plurality of spaced-apart nozzle holes disposed on an inner rim of said arcuate frontal portion of the seat, respective nozzle holes having respective orientations to direct respective water streams in a generally converging pattern extending (a) generally horizontally, (b) upwardly to a limited degree to impinge upon the region of a person's genitalia when seated on the toilet seat, and a water source connected with said conduit means.

2. Apparatus according to claim 1, wherein said nozzle holes are defined in the conduit means which is secured to a lower portion of said frontal portion of the seat and connected with said water source.

3. Apparatus according to claim 2, wherein said nozzle holes are disposed at a lower bottom edge portion of the frontal portion of the seat.

4. Apparatus according to claim 1, wherein said conduit means comprises a passage within said frontal portion of the seat, and said nozzle holes are defined in the seat.

5. Apparatus according to claim 4, wherein said nozzle holes are disposed at a lower bottom edge portion of the frontal portion of the seat.

6. Apparatus according to claim 1, wherein the conduit means comprises a plastic tube secured to a lower frontal rim portion of the seat.

7. Apparatus according to claim 1, wherein:

said nozzle holes are respectively oriented to direct a plurality of respective water streams in directions to impinge upon a person's private parts below the thigh region with the person seated on the toilet seat.

8. Apparatus according to claim 1, wherein said nozzle holes are so spaced that a central space has no nozzle holes to avoid direct impingement of water streams on male genitalia.

9. A bidet toilet seat comprising:

a toilet seat having an arcuate frontal portion, a central opening, and a rear portion pivotally connected with a toilet bowl, conduit means having a plurality of spaced-apart nozzle holes disposed on an inner rim of said arcuate frontal portion of the seat, respective nozzle holes having respective orientations to direct respective water streams in a generally converging pattern extending (a) generally horizontally, (b) upwardly to a limited degree to impinge upon the region of a person's genitalia when seated on the toilet seat, a water source connected with said conduit means, and valve means adjustable to control water flow from the water source to control the force and distance of said water streams.

10. Apparatus according to claim 9, wherein said conduit means comprises a plastic tube secured to a lower frontal rim portion of the toilet seat.

11. Apparatus according to claim 9, wherein said valve means is mounted on the toilet seat and is manually operable to control flow.

12. Apparatus according to claim 9, wherein said nozzle holes are defined in the conduit means which is secured to a lower frontal portion of the seat connected with said valve means.

13. Apparatus according to claim 9, wherein said conduit means comprises a passage within said frontal portion of the seat, and said nozzle holes are defined in the seat.

14. Apparatus according to claim 9, wherein said nozzle holes are disposed on a lower bottom edge of the frontal portion of the seat.

15. Apparatus according to claim 9, wherein said conduit means and said valve means are connected with a utility water supply.

* * * * *